US010655509B2

(12) United States Patent
Mukaide

(10) Patent No.: US 10,655,509 B2
(45) Date of Patent: May 19, 2020

(54) VARIABLE VALVE TIMING CONTROL DEVICE

(71) Applicant: AISIN SEIKI KABUSHIKI KAISHA, Kariya-shi, Aichi-ken (JP)

(72) Inventor: Hiroki Mukaide, Chiryu (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 16/275,846

(22) Filed: Feb. 14, 2019

(65) Prior Publication Data

US 2019/0277168 A1 Sep. 12, 2019

(30) Foreign Application Priority Data

Mar. 8, 2018 (JP) ..... 2018-042344

(51) Int. Cl.
*F01L 1/352* (2006.01)
*F01L 1/344* (2006.01)

(52) U.S. Cl.
CPC ..... *F01L 1/352* (2013.01); *F01L 1/34403* (2013.01); *F01L 2250/02* (2013.01); *F01L 2250/04* (2013.01); *F01L 2810/02* (2013.01); *F01L 2810/04* (2013.01); *F01L 2820/032* (2013.01)

(58) Field of Classification Search
CPC ... F01L 1/352; F01L 1/46; F01L 1/047; F01L 1/344; F01L 1/34403; F01L 2013/103; F01L 2820/032; F01L 2810/02; F01L 2810/04; F01L 2250/02; F01L 2250/04
USPC ..... 123/90.17, 90.15
See application file for complete search history.

(56) References Cited

U.S. PATENT DOCUMENTS

2018/0306070 A1* 10/2018 Mukaide ..... F01L 1/352
2018/0371964 A1* 12/2018 Miyachi ..... F01L 1/352

FOREIGN PATENT DOCUMENTS

JP 2015102064 A 6/2015
JP 2017115601 A 6/2017

* cited by examiner

*Primary Examiner* — Devon C Kramer
*Assistant Examiner* — Kelsey L Stanek
(74) *Attorney, Agent, or Firm* — Buchanan Ingersoll & Rooney PC

(57) ABSTRACT

A variable valve timing control device includes a connection mechanism provided with a coupling member which connects a driving-side rotation member and an input gear with each other, the connection mechanism including a first engagement portion and a second engagement portion, the first engagement portion engaged with the driving-side rotation member so as to be relatively displaceable therewith in a first radial direction, the second engagement portion engaged with the input gear so as to be relatively displaceable therewith in a second radial direction which is orthogonal to the first radial direction, and a biasing member restricting a coupling member from being displaced.

7 Claims, 9 Drawing Sheets

VARIABLE VALVE TIMING CONTROL DEVICE

CROSS REFERENCE TO RELATED APPLICATIONS

This application is based on and claims priority under 35 U.S.C. § 119 to Japanese Patent Application 2018-042344, filed on Mar. 8, 2018, the entire content of which is incorporated herein by reference.

TECHNICAL FIELD

This disclosure generally relates to a variable valve timing control device.

BACKGROUND DISCUSSION

A known variable valve timing control device which changes opening and closing timings of an intake valve and an exhaust valve in accordance with an operation status of an internal combustion engine (hereinafter also referred to as an engine) is practically employed. The variable valve timing control device includes a mechanism that changes the opening and closing timings of the intake and exhaust valves which are opened and closed in accordance with the rotation of a driven-side rotation member by changing of a relative rotation phase of the driven side rotation phase relative to a driving-side rotation member (hereinafter also referred to as a relative rotation phase) by the operation of the engine.

The variable valve timing control device conventionally changes the relative rotation phase by an oil pressure. However, by the recent employment of an electric automobile, an electric valve opening and closing timing control device changing a relative rotation phase electrically by employment of an electric actuator (motor) is developed. The electric variable valve timing control device changes the relative rotation phase by the motor, and thus the relative rotation phase is speedily changed in accordance with an order from an ECU.

The aforementioned electric variable valve timing control device is disclosed in JP2017-115601A (hereinafter referred to as Patent reference 1). According to Patent reference 1, the variable valve timing control device is provided with the driven-side rotation member (ring gear) including an internal teeth portion which is accommodated inside the driving-side rotation member (outer case) so as to be relatively rotatable therewith. The variable valve timing control device further includes an inner gear which is disposed inside the ring gear, the inner gear including an external teeth portion which meshes with a part of the internal teeth portion of the ring gear. The variable valve timing control device further includes an electric actuator (an electric motor) which drives the inner gear, and a coupling member which connects the driving-side rotation member and the inner gear with each other.

According to Patent reference 1, the driving-side rotation member and the driven-side rotation member are disposed so as to be rotatable about a rotation axis, and the inner gear is disposed so as to be rotatable about an eccentric axis which is in parallel with the rotation axis. Accordingly, a first engagement portion of the coupling member is engaged with the driving-side rotation member, and a second engagement portion of the coupling member is engaged with the inner gear.

According to Patent reference 1, the coupling member includes a pair of first engagement arms extending radially outward, and groove portions engaged with the first engagement arms are formed at an outer circumferential portion of the driving-side rotation member. The coupling member further includes a pair of second engagement arms in a direction orthogonal to an extending direction of the first engagement arms, and protrusions being fitted to engagement recessed portions of the second engagement arms are formed at the inner gear.

According to Patent reference 1, the first engagement arms and the grooves are in contact with one another, and the protrusions are in contact with the engagement recessed portions of the second engagement arms, and thus, in a case where alternating torque is applied to a camshaft, contact noises are generated by a phenomenon in which the contact and the separation at the contact portions repeatedly occur. Accordingly, undesired sound may be generated.

A need thus exists for a variable valve timing control device which is not susceptible to the drawback mentioned above.

SUMMARY

According to an aspect of this disclosure, a variable valve timing control device includes a driving-side rotation member disposed to be rotatable about a rotation axis and rotating synchronously with a crankshaft of an internal combustion engine, a driven-side rotation member housed in the driving-side rotation member so as to be relatively rotatable with the driving-side rotation member about the rotation axis and rotating integrally with a camshaft for opening and closing a valve of the internal combustion engine, and a phase adjustment mechanism specifying a relative rotation phase between the driving-side rotation member and the driven-side rotation member by a drive force of an electric actuator, the phase adjustment mechanism configured by a differential reduction gear mechanism including an output gear, an input gear, and a connection mechanism, the output gear coaxially disposed with the rotation axis and having inner teeth, the input gear disposed coaxially with an eccentric axis which is oriented to be in parallel with the rotation axis and having outer teeth, the outer teeth including a part which is engaged with a part of the inner teeth of the output gear, the connection mechanism connecting the input gear and the driving-side rotation member with each other to rotate the input gear and the driving-side rotation member, the reduction gear mechanism which revolves the input gear about the rotation axis while rotating the input gear about the eccentric axis by the drive force of the electric actuator, the connection mechanism including a coupling member which connects the driving-side rotation member and the input gear with each other, the connection mechanism including a first engagement portion and a second engagement portion, the first engagement portion engaged with the driving-side rotation member so as to be relatively displaceable therewith in a first radial direction, the second engagement portion engaged with the input gear so as to be relatively displaceable therewith in a second radial direction which is orthogonal to the first radial direction, and a biasing member restricting the coupling member from being displaced.

According to another aspect of this disclosure, a variable valve timing control device includes a driving-side rotation member disposed to be rotatable about a rotation axis and rotating synchronously with a crankshaft of an internal combustion engine, a driven-side rotation member housed in the driving-side rotation member so as to be relatively rotatable with the driving-side rotation member about the rotation axis and rotating integrally with a camshaft for opening and closing a valve of the internal combustion engine, and a phase adjustment mechanism specifying a relative rotation phase between the driving-side rotation member and the driven-side rotation member by a drive force of an electric actuator, the phase adjustment mechanism configured by a reduction gear mechanism including an input gear, an output gear, and a connection mechanism, the input gear including a natural number of teeth and driven by the electric actuator, the output gear including a number of teeth which is greater than the natural number of teeth of the input gear by one and meshed with the input gear, and the connection mechanism connecting the input gear and the driving-side rotation member with each other and rotating the input gear and the driving-side rotation member, the connection mechanism including a coupling member which connects the driving-side rotation member and the input gear with each other, the connection mechanism including a first engagement portion and a second engagement portion, the first engagement portion engaged with the driving-side rotation member so as to be relatively displaceable therewith in a first radial direction, the second engagement portion engaged with the input gear so as to be relatively displaceable therewith in a second radial direction which is orthogonal to the first radial direction, and a biasing member including a first spring and a second spring, the first spring biasing the coupling member in a first direction along the rotation axis, and the second spring biasing the coupling member in a second direction opposite to the first direction along the rotation axis.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of the disclosure will hereunder be explained with reference to the drawings.

Figure 1:
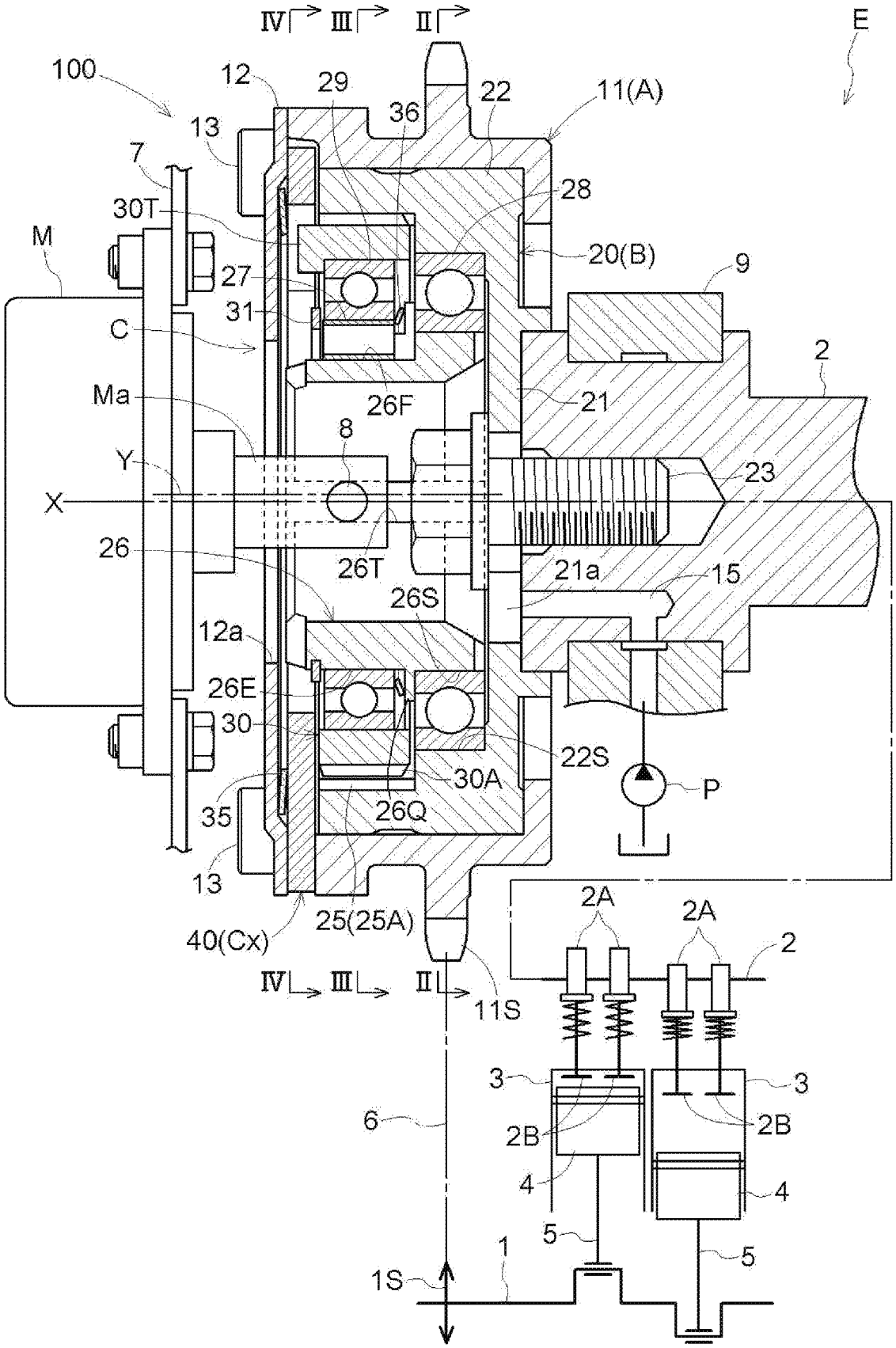
FIG. 1 is a cross sectional view of a variable valve timing control device according to a first embodiment disclosed here.

As illustrated in FIG. 1, a variable valve timing control device includes a driving-side rotation member A, a driven-side rotation member B, and a phase adjustment mechanism C. The driving-side rotation member A rotates synchronously with a crankshaft 1 of an engine E serving as an internal combustion engine. The driven-side rotation member B integrally rotates with an intake camshaft 2 (i.e., serving as a camshaft) about a rotation axis X. The phase adjustment mechanism C sets a relative rotation phase of the driving-side rotation member A and the driven-side rotation member B by drive force of a phase control motor M (an example of an electric actuator).

The engine E is configured such that pistons 4 are accommodated in plural cylinder bores 3 provided at a cylinder block, and the pistons 4 are connected to the crankshaft 1 by connecting rods 5 to form a four-cycle engine. A timing chain 6 (for example, a timing belt may be alternated) is wound around an output sprocket 1S of the crankshaft 1 of the engine E and a drive sprocket 11S of the driving-side rotation member A.

The engine E is provided with an exhaust camshaft other than the intake camshaft 2, and the timing chain 6 is wound around a sprocket being connected to the exhaust camshaft. Alternatively, the variable valve timing control device 100 including a configuration illustrated in FIG. 1 may be provided at the exhaust camshaft.

Accordingly, when the engine E is operated, the whole variable valve timing control device 100 rotates about the rotation axis X. The phase control mechanism C is operated by drive force of the phase control motor M, and thus the driven-side rotation member B is displaced relative to the driving-side rotation member A in a direction or an opposing direction of the rotation direction of the driving-side rotation member A. The relative rotation phase of the driving-side rotation member A and the driven-side rotation member B is set by displacement by the phase adjustment mechanism C, and thus the opening and closing timing of intake valves 2B is controlled by cam portions 2A of the intake camshaft 2.

The displacement of the driven-side rotation member B in the same direction as the rotation direction of the driving-side rotation member A is referred to as an advancing operation which increases the intake compression ratio. The displacement of the driven-side rotation member B in the opposing direction of the rotation direction of the driving-side rotation member A (the displacement in the opposing direction of the aforementioned direction) is referred to as a retarded operation which decreases the intake compression ratio.

As illustrated in FIGS. 1 to 4, the driving-side rotation member A includes an outer case 11 and a front plate 12 that are joined with each other by plural joint bolts 13. The outer case 11 includes the drive sprocket 11S at an outer circumference thereof. The front plate 12 includes an opening portion 12*a* at a center portion thereof. The outer case 11 is formed in a bottomed cylindrical shape including an opening at a bottom portion thereof.

An intermediate member 20 serving as the driven-side rotation member B, and the phase control mechanism C functioning as a reduction gear mechanism are accommodated in an inner space of the outer case 11. The phase control mechanism C includes an Oldam coupling Cx serving as a connection mechanism changing the phase of the driving-side rotation member A and the driven-side rotation member B. The Oldam coupling Cx connects an input gear 30 and the outer case 11 with each other to equally rotate the input gear 30 and the outer case 11.

The intermediate member 20 serving as the driven-side rotation member B includes a support wall portion 21 and a cylindrical wall portion 22 that are integrally provided. The support wall portion 21 is connected to the intake camshaft 2 in an orientation orthogonal to the rotation axis X. The cylindrical wall portion 22 is formed in a cylindrical shape about the rotation axis X, and protrudes in a direction away from the intake camshaft 2.

The intermediate member 20 is formed such that an outer surface of the cylindrical wall portion 22 is relatively rotatably fitted on an inner surface of the outer case 11 so as to be in contact therewith, and the intermediate member 20 is fixed to an end portion of the intake camshaft 2 by a connection bolt 23 communicating with a through hole of a center of the support wall portion 21. In this fixed state, an end portion of the cylindrical wall portion 22 provided outward thereof (farther side relative to the intake camshaft 2) is disposed inward relative to the front plate 12.

The variable valve timing control device 100 includes a lubricating oil passage 15 supplying lubricating oil from an oil pump P disposed outside via an oil passage forming member 9. The supplied lubricating oil is supplied inside the apparatus from a lubricating groove portion 21*a* of the support wall portion 21 of the intermediate member 20.

The phase control motor M (the electric motor) is supported by the engine E such that an output shaft Ma thereof is disposed so as to be coaxial with the rotation axis X by a support frame 7. The output shaft Ma of the phase control motor M is provided with a pair of engagement pins 8 which are oriented orthogonal to the rotation axis X.

As illustrated in FIGS. 1 to 5, the phase adjustment mechanism C includes the intermediate member 20, an output gear 25 provided at an inner circumferential surface of the cylindrical wall portion 22 of the intermediate member 20, an eccentric member 26, a spring member 27, a first bearing 28, a second bearing 29, the input gear 30, a restriction ring 31, and the Oldam coupling Cx. The first bearing 28 and the second bearing 29 correspond to ball bearings, respectively. Alternatively, bushes may be employed for the first bearing 28 and the second bearing 29.

The phase adjustment mechanism C serves as a differential reduction gear mechanism which rotates the input gear 30 about an eccentric axis Y and which revolves the input gear 30 about the rotation axis X by driving of the phase control motor M.

The phase adjustment mechanism C includes a plate-shaped coupling member 40 serving as the Oldam coupling Cx, a first annular spring 35 (i.e., serving as a biasing member) (an example of a first spring) between the coupling member 40 and the front plate 12, and a second annular spring 36 (i.e., serving as a biasing member) (an example of a second spring) relative to the coupling member 40 in a state where the second annular spring 36 is fitted onto the eccentric member 26. The first annular spring 35 and the second annular spring 36 each includes the same configuration as a plate spring. Alternatively, curved washers may be employed for the first annular spring 35 and the second annular spring 36.

The first annular spring 35 applies biasing force to the coupling member 40 in a direction approaching the intake camshaft 2 along the rotation axis X (right direction in FIG. 1, hereinafter referred to as an inside). The second annular spring 36 applies biasing force to the input gear 30 in a direction away from the intake camshaft 2 along the rotation axis X (left direction in FIG. 1, hereinafter referred to as an outside).

A support surface 22S about the rotation axis X is provided inside (a position adjacent to the support wall portion 21) the inner circumference of the cylindrical wall portion 22 of the intermediate member 20 along the rotation axis X, and the output gear 25 is integrally provided with the support surface 22S which is disposed outward thereof (farther side relative to the intake camshaft 2) and which is about the rotation axis X.

The eccentric member 26 is formed in a cylindrical shape and is provided with a circumferential support surface 26S and an eccentric support surface 26E. The circumferential support surface 26S serves as an outer circumferential surface about the rotation axis X and is disposed inside (a side close to the intake camshaft 2) in a direction along the rotation axis X. The eccentric support surface 26E serving as an outer circumferential surface which is off-centered about the eccentric axis Y so as to be oriented in parallel with the rotation axis X is provided at the outside (a side away from the intake camshaft 2). The spring member 27 is fitted into a recessed portion 26F provided at the outer circumference of the eccentric support surface 26E.

The spring member 27 corresponds to a spring member which is curved to be formed in a U shape, and applies biasing force to the input gear 30 so that a positioning portion of outer teeth 30A of the input gear 30 is meshed with a part of inner teeth 25A of the output gear 25. The spring member 27 is prevented from being fallen off by the restriction ring 31 being fitted to the outer circumference of the eccentric member 26.

The eccentric member 26 includes a flange portion 26Q which is disposed at a border line of the circumferential support surface 26S and the eccentric support surface 26E, and includes a diameter larger than the diameters of the circumferential support surface 26S and the eccentric support surface 26E. The second annular spring 36 is disposed such that a first surface of the second annular spring 36 is in contact with the flange portion 26Q and a second surface of the second annular spring 36 is in contact with an inner race of the second bearing 29.

A pair of engagement grooves 26T engaged with the pair of engagement pins 8 of the phase control motor M is provided in parallel with the rotation axis X.

Figure 2:
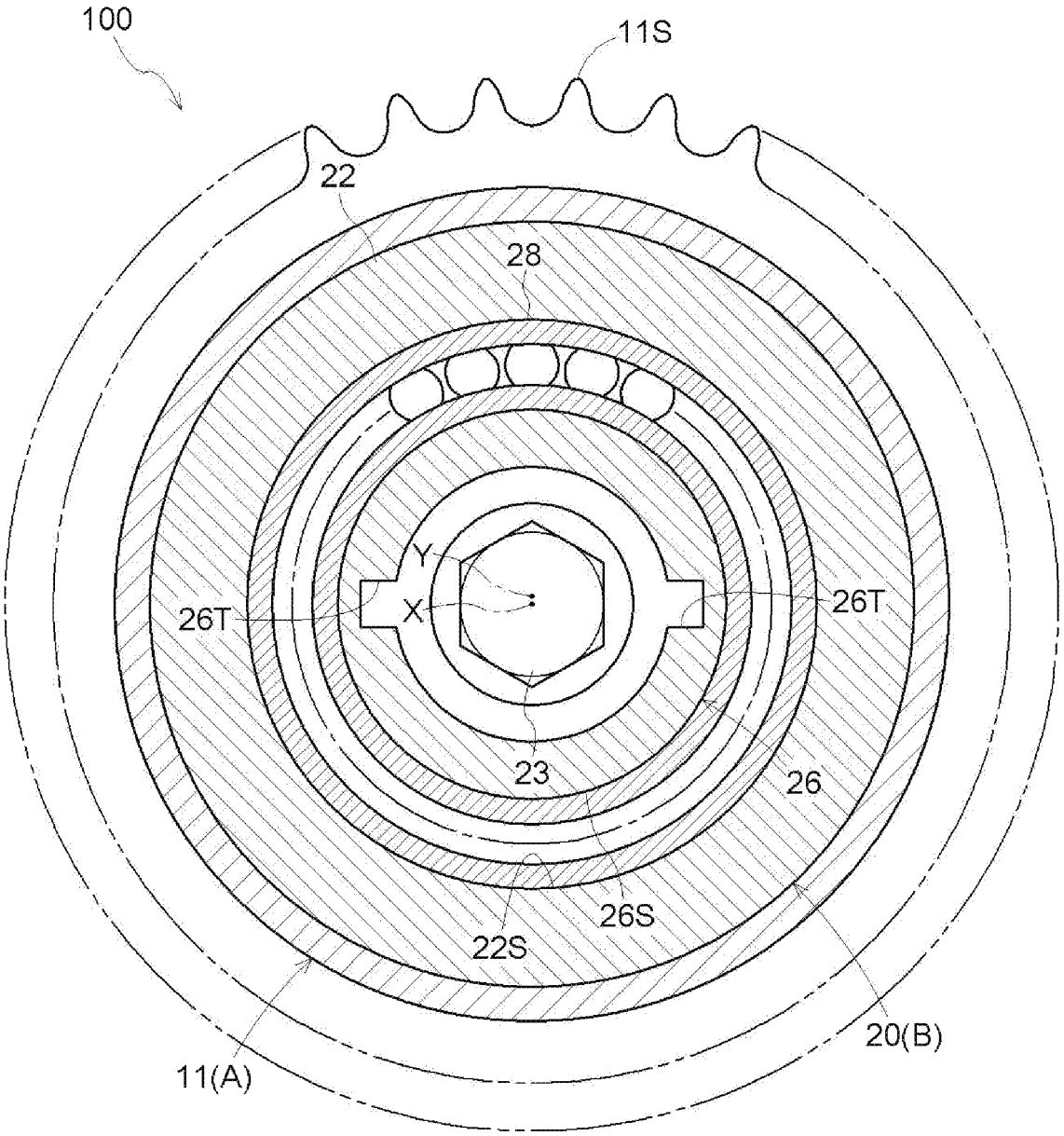
FIG. 2 is a cross sectional view taken along line II-II in FIG. 1.
Figure 3:
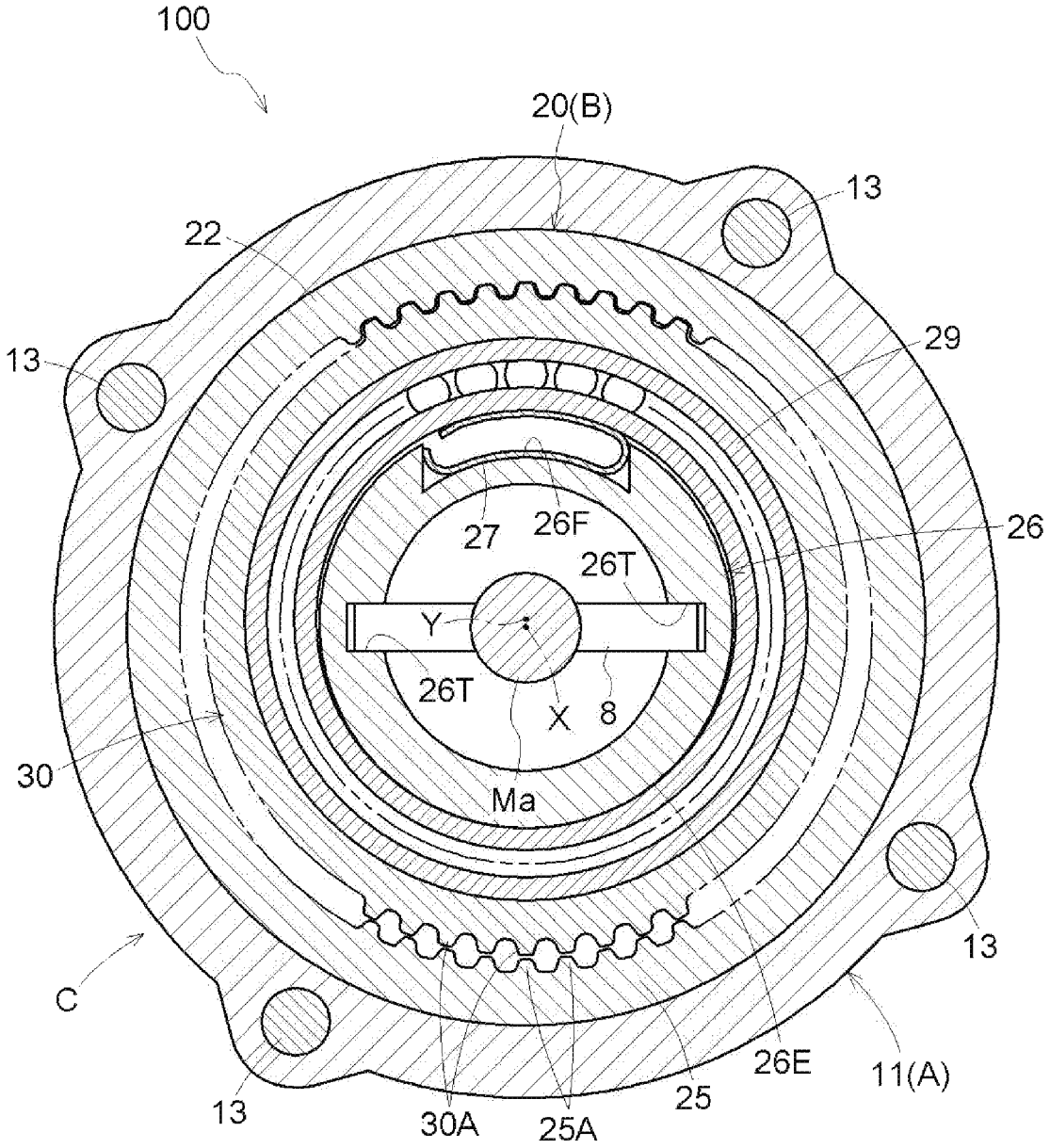
FIG. 3 is a cross sectional view taken along line III-III in FIG. 1.

As illustrated in FIGS. 1 and 2, the first bearing 28 is fitted onto the circumferential surface 26S, and the support surface 22S of the cylindrical wall portion 22 is fitted onto the first bearing 28. Accordingly, the eccentric member 26 is rotatably supported about the rotation axis X relative to the intermediate member 20. As illustrated in FIGS. 1 and 3, the input gear 30 is rotatably supported about the eccentric axis Y relative to the eccentric support surface 26E of the eccentric member 26 via the second bearing 29.

In the phase adjustment mechanism C, the input gear 30 is provided with the outer teeth 30A including plural teeth at an outer circumference thereof, and is provided with a pair of engagement protrusions 30T (i.e., serving as a second engagement portion) protruding outwardly along the rotation axis X. The inner teeth 25A including plural teeth is integrally provided at an inner circumference of the intermediate member 20.

Specifically, the number of teeth of the outer teeth 30A of the input gear 30 is set less than the number of teeth of the inner teeth 25A of the output gear 25 by one. A part of the outer teeth 30A of the input gear 30 is meshed with a part of the inner teeth 25A of the output gear 25.

Figure 4:
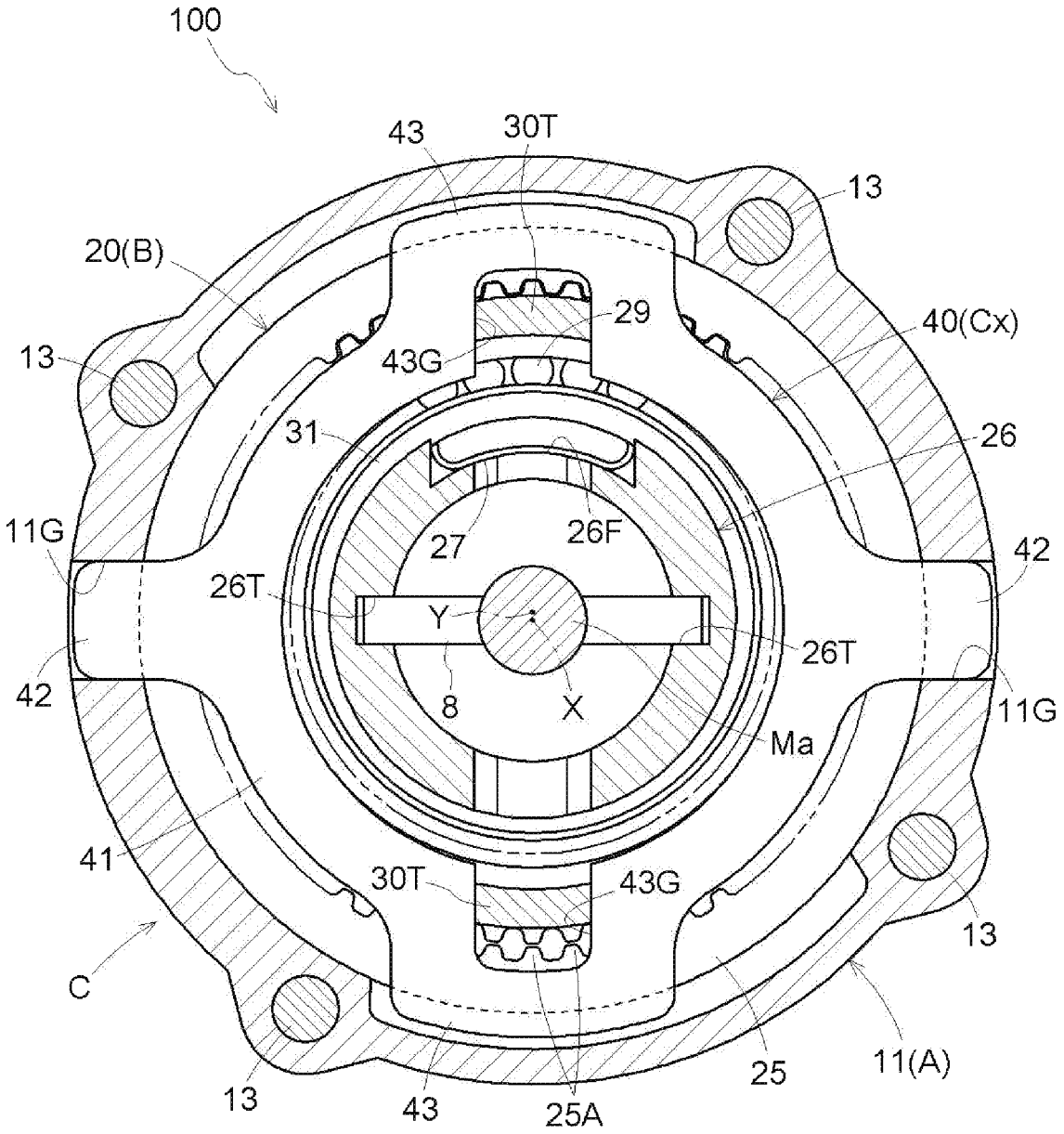
FIG. 4 is a cross sectional view taken along line IV-IV in FIG. 1.
Figure 5:
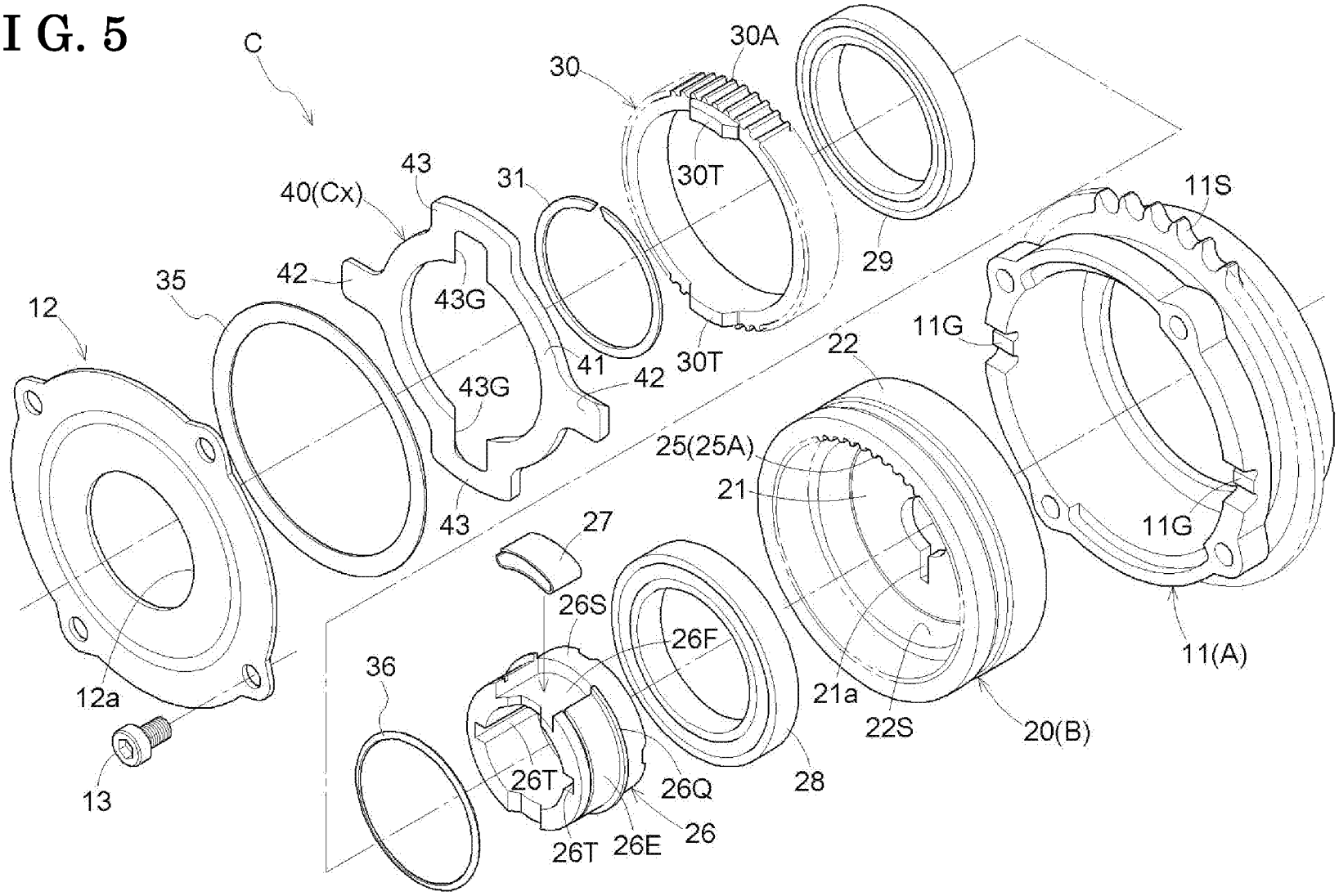
FIG. 5 is an exploded perspective view of the variable valve timing control device.

As illustrated in FIGS. 1, 4, and 5, the Oldam coupling Cx is configured as the plate-shaped coupling member 40 in which a center annular portion 41, a pair of external engagement arms 42 (i.e., serving as a first engagement portion, an engagement arm), and internal engagement arms 43 (i.e., serving as a second engagement portion) are integrally provided. The external engagement arms 42 (a part of a first engagement portion) protrude radially outward along a first radial direction (right-and-left direction in FIG. 4) from the annular portion 41. The internal engagement arms 43 (a part of a second engagement portion) protrude radially outward along a second radial direction (upper-lower direction in FIG. 4) from the annular portion 41, the second radial direction which is orthogonal to the first radial direction. The internal engagement arms 43 are provided with engagement recessed portions 43G (i.e., serving as a recessed portion), respectively, which are continuously provided with the opening of the annular portion 41.

Figure 6:
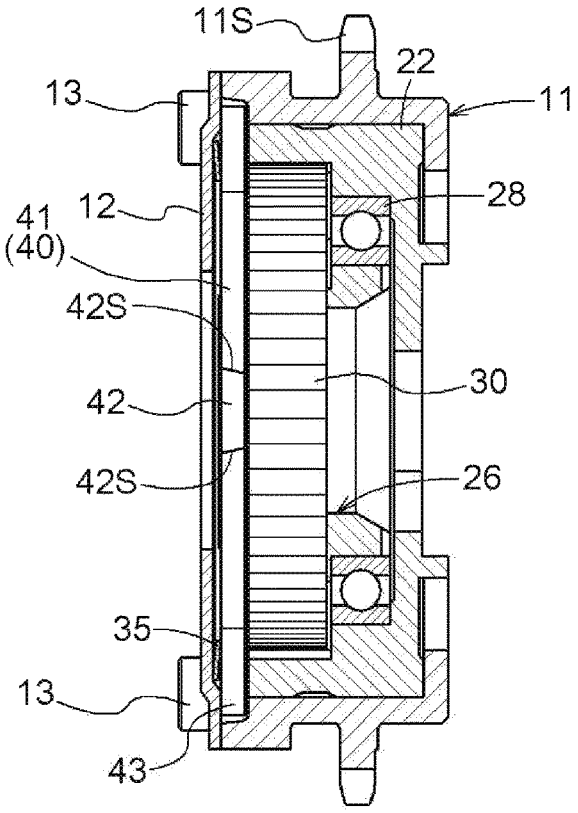
FIG. 6 is a partial cutout view of the variable valve timing control device illustrating, for example, a shape of a coupling member.
Figure 7:
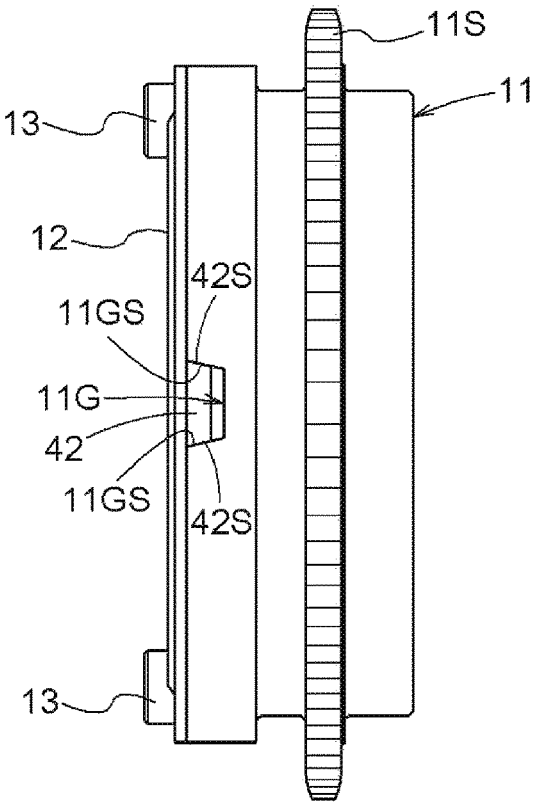
FIG. 7 is a side view of the variable valve timing control device illustrating an engagement state of an outer engagement arm.

Specifically, as illustrated in FIGS. 6 and 7, two arm surfaces 42S being inclined relative to the rotation axis X are provided so that an arm width (a dimension in the upper-lower direction in FIGS. 6 and 7) of the pair of external engagement arms 42 of the coupling member 40 is wider towards an arm back surface side (left in FIG. 7) which is opposite to the external engagement arm 42 than an arm engagement side (right in FIG. 7) facing groove bottom surfaces of guide groove portions 11G (a part of the first engagement portion, i.e., serving as the groove portion).

Figure 8:
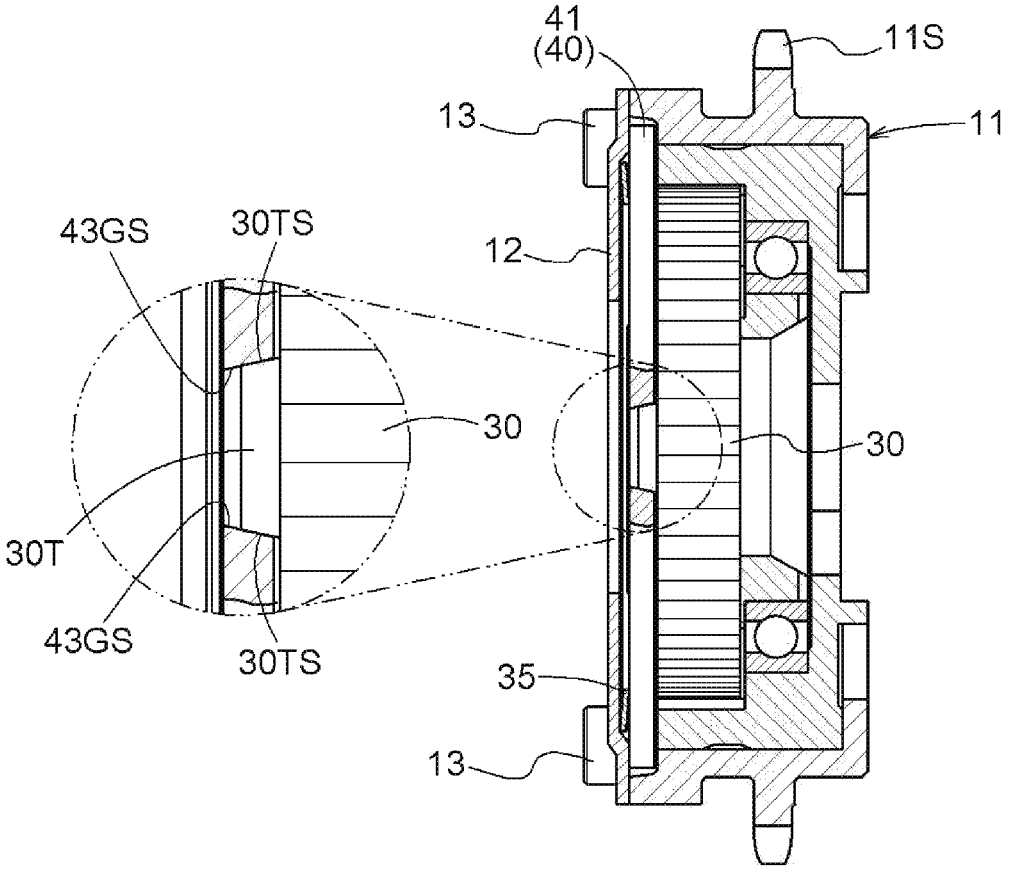
FIG. 8 is another partial cutout view and a partial enlarged view of the variable valve timing control device illustrating, for example, the shape of the coupling member.
Figure 9:
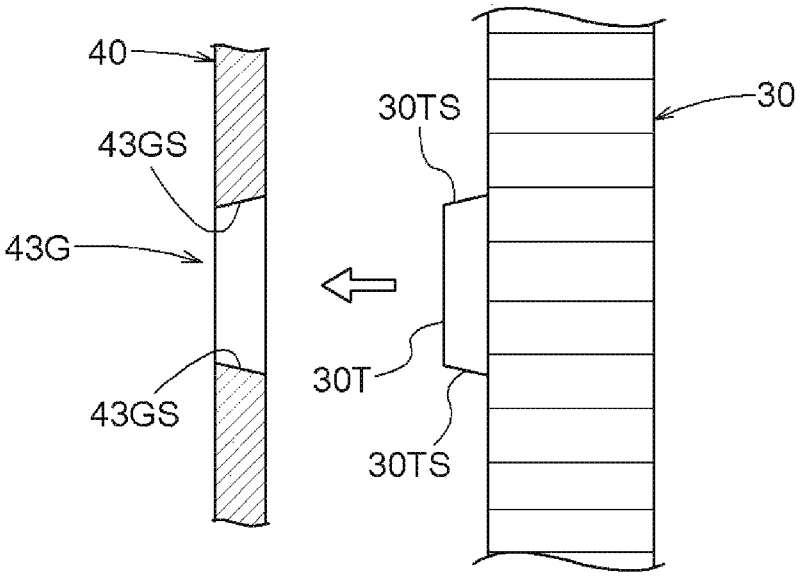
FIG. 9 is a side view of the partial cutout view of an engagement recessed portion and an engagement protrusion.

As illustrated in FIGS. 8 and 9, two recessed portion side surfaces 43GS being inclined relative to the rotation axis X are provided so that each of recessed portion widths (dimension in the upper-lower direction in FIG. 8) of the engagement recessed portions 43G of the pair of internal engagement arms 43 of the coupling member 40 is narrower towards the back portion side opposing the input gear 30 than a recessed portion opening side facing the input gear 30.

As illustrated in FIG. 4, an opening rim portion of the outer case 11, the opening rim portion being in contact with the front plate 12, is provided with a pair of guide groove portions 11G which is formed in a through groove shape, which is provided from an internal space to an outer space of the outer case 11, and which extends in the radial direction about the rotation axis X. As illustrated in FIGS. 6 and 7, two groove side surfaces 11GS being inclined relative to the rotation axis X are provided so that the groove width of the guide groove portions 11G is wider towards the groove opening side (left in FIG. 7) where the external engagement arms 42 are provided than the groove bottom side (right in FIG. 7).

As illustrated in FIGS. 8 and 9, a pair of engagement protrusions 30T (a part of the second engagement portion) of the input gear 30 is provided with two protrusion side surfaces 30TS being inclined relative to the rotation axis X so that the engagement width at a base end of the engagement protrusion 30T is wider than the engagement width (width in the upper-lower direction in FIG. 8) of a protruding end side of the engagement protrusion 30T.

According to the aforementioned configuration, the pair of external engagement arms 42 of the coupling member 40 is engaged with a corresponding portion of the pair of guide groove portions 11G of the outer case 11, and the engagement recessed portions 43G of the pair of internal engagement arms 43 of the coupling member 40 are engaged with corresponding portions of the pair of engagement protrusions 30T of the input gear 30.

According to the aforementioned engagement, the coupling member 40 is displaced relative to the outer case 11 in a first direction (right-left direction in FIG. 4) in which the external engagement arms 42 extend, and the engagement recessed portions 43G of the internal engagement arms 43 is displaced relative to the input gear 30 in a second direction (upper-lower direction in FIG. 4) in which the engagement recessed portions 43G extend to establish the Oldam coupling Cx.

In the Oldam coupling Cx, each of the inclination angles of the two arm side surfaces 42S of the pair of external engagement arms 42 of the coupling member 40, and each of the inclination angles of the two groove side surfaces 11GS of the guide groove portions 11G of the outer case 11 are equal to each other. Accordingly, as illustrated in FIG. 7, the arm side surfaces 42S and the groove side surfaces 11GS are in surface-contact with one another in a state where the external engagement arms 42 and the guide groove portions 11G are engaged with each other.

As in the case with the aforementioned configuration, each of the inclination angles of the two recessed portion side surfaces 43GS of the engagement recessed portions 43G of the pair of internal engagement arms 43 of the coupling member 40, and each of the inclination angles of the two protrusion side surfaces 30TS of the engagement protrusions 30T of the input gear 30 are equal to each other. Accordingly, as illustrated in FIG. 8, the recessed side surfaces 43GS and the protrusion side surfaces 30TS are in surface-contact with one another in a state where the engagement recessed portions 43G and the engagement protrusions 30T are engaged with one another.

As illustrated in FIG. 1, the variable valve timing control device 100 which is in an assembling state is configured such that the support wall portion 21 of the intermediate portion 20 is connected with the end portion of the intake camshaft 2 by the connection bolt 23, and the intake shaft 2 and the intermediate member 20 are integrally rotated with each other. The eccentric member 26 is relatively rotatably supported about the rotation axis X relative to the intermediate member 20 by the first bearing 28. As illustrated in FIGS. 1 and 2, the input gear 30 is supported relative to the eccentric support surface 26E of the eccentric member 26 via the second bearing 29, and a part of the outer teeth 30A of the input gear 30 is meshed with a part of the inner teeth 25A of the output gear 25.

In addition, as illustrated in FIG. 4, the external engagement arms 42 of the Oldam coupling Cx are engaged with the pair of guide groove portions 11G of the outer case 11, and the engagement protrusions 30T of the input gear 30 are engaged with the engagement recessed portions 43G of the internal engagement arms 43 of the Oldam coupling Cx. As illustrated in FIG. 1, the front plate 12 is disposed outward of the coupling member 40 of the Oldam coupling Cx, and the first annular spring 35 is disposed between the front plate 12 and the coupling member 40. Accordingly, the biasing force displacing the coupling member 40 in a direction of the input gear 30 along the rotation axis X is applied to the coupling member 40.

In addition, the second annular spring 36 is disposed between the end portion of the internal surface of the input gear 30 and the flange portion 26Q of the eccentric member 26, and thus the biasing force displacing the input gear 30 in the direction of the coupling member 40 along the rotation axis X is applied to the input gear 30.

As illustrated in FIGS. 1 to 3, the engagement pins 8 being provided at the output shaft Ma of the phase control motor M are engaged with the engagement grooves 26T of the eccentric member 26, respectively.

The phase control motor M is controlled by a control device serving as an ECU, or an electronic control unit. The engine E includes a sensor which detects the rotation speeds (number of rotation per unit time) of the crank shaft 1 and the intake camshaft 2 and the rotation phase thereof, and detection signals of the sensor are inputted to the control device.

The control device maintains the relative rotation phase of the crank shaft 1 and the intake camshaft 2 by driving of the phase control motor M with a speed equal to the rotation speed of the intake camshaft 2 when the engine E is operated. On the other hand, the rotation speed of the phase control motor M is decreased or increased relative to the rotation speed of the intake camshaft 2, and thus the relative rotational phase is changed. In a case where the relative rotation phase of the crank shaft 1 and the intake camshaft 2 is displaced in the advanced-angle direction, the intake compression ratio is increased, and in a case where the relative rotation phase of the crank shaft 1 and the intake camshaft 2 is displaced in the retarded-angle direction, the intake compression ratio is decreased.

Considering the operation mode in a state where the engine E is in a stopped state, because the eccentric member 26 is supported by the first bearing 28, the eccentric member 26 rotates about the rotation axis X in a case where the phase control motor M is driven. The input gear 30 is rotatably supported about the eccentric axis Y via the second bearing 29, and thus the input gear 30 revolves about the rotation axis X in accordance with the rotation of the eccentric member 26.

In the phase adjustment mechanism C, the outer teeth 30A of the input gear 30 which is displaced in a direction of the eccentric axis Y with reference to the rotation axis X is meshed with the inner teeth 25A of the output gear 25. Thus, in a case where the input gear 30 revolves, the meshed position of the outer teeth 30A of the input gear 30 and the inner teeth 25A of the output gear 25 is displaced circumferentially along the inside of the output gear 25, and the rotation force about the eccentric axis Y is applied to the input gear 30.

As described above, the number of teeth of the outer teeth 30A of the input gear 30 is set less than the number of teeth of the inner teeth 25A of the output gear 25 by one, and thus, in a case where the input gear 30 is revolved around, the rotation force is applied to the input gear 30 by an angle (the angle corresponding to a tooth in the first embodiment) corresponding to a difference (the difference in the number of teeth) between the number of teeth of the inner teeth 25A of the output gear 25 and the number of teeth of the outer teeth 30A of the input gear 30.

Even though the input gear 30 is applied with the rotation force, the coupling member 40 inhibits the relative rotation of the outer case 11 and the input gear 30, and thus the input gear 30 does not relatively rotate with the outer case 11, and the output gear 25 rotates relative to the outer case 11 by the rotation force applied to the input gear 30.

As a result, in a case where the input gear 30 revolves only by one about the rotation axis X, an adjustment by a large reduction ratio is employed, the large reduction ration to rotate the intake camshaft 2 relative to the outer case 11 only by an angle corresponding to the difference (the difference in the number of teeth) between the number of teeth of the inner teeth 25A of the output gear 25 and the number of teeth of the outer teeth 30A of the input gear 30.

In a case where the eccentric axis Y of the input gear 30 revolves about the rotation axis X, the coupling member 40 of the Oldam coupling Cx is displaced in the extending direction (the first direction) of the external engagement arms 42 relative to the outer case 11, and the input gear 30 is displaced in the extending direction (the second direction) of the internal engagement arms 43 in accordance with the revolving of the input gear 30.

As described above, the biasing force of the first annular spring 35 is applied to the coupling member 40 to displace the coupling member 40 inward along the rotation axis X, and thus as illustrated in FIG. 7, the arm side surfaces 42S of the pair of external engagement arms 42 of the coupling member 40 come in contact with the groove side surfaces 11GS of the guide groove portions 11G of the outer case 11, respectively.

As described above, the biasing force of the second annular spring 36 is applied to the input gear 30 to displace the input gear 30 inward along the rotation axis X, and thus as illustrated in FIG. 8, the protrusion side surfaces 30TS of the pair of engagement protrusions 30T of the input gear 30 come in contact with the recessed side surfaces 43GS of the pair of internal engagement arms 43 of the coupling member 40, respectively.

As such, because the contact state is maintained, even, for example, the alternating torque is applied to the intake camshaft 2 when the engine E is operated, a state where the arm side surfaces 42S is in contact with the groove side surfaces 11GS is maintained by the application of the biasing force of the first annular spring 35, and at the same time, a state where the recessed portion side surfaces 43GS come in contact with the protrusion side surfaces 30TS is maintained by the biasing force of the second annular spring 36, and thus the contact noise is inhibited from being generated.

A first modified example will hereunder be explained in addition to the aforementioned first embodiment. The same components as those described in the first embodiment are marked with the same reference numerals.

A torsion spring applying the rotation force to the coupling member 40 about the rotation axis X may be employed. The torsion spring may be combined with the first annular spring 35 and the second annular spring 36 of the first embodiment.

In the first modified example, comparing to the configuration in which the biasing force is applied to the coupling member 40 in the direction along the rotation axis X, for example, the side wall portions of the guide groove portions 11G and the side wall portions of the external engagement arms 42 are retained in a contact state by the application of the rotation force to the coupling member 40, for example, and thus the groove side surfaces 11GS, the arm side surfaces 42S, the recessed portion side surfaces 43GS, and the protrusion side surfaces 30TS do not have to be formed as inclination surfaces.

For example, a non-metal material, for example, an o-ring made of rubber or resin may be employed for the first annular spring 35 (the first spring) and the second annular spring 36 (the second spring). Compressed coil springs, tensile coil springs, or plate springs may be employed for the first spring and the second spring.

According to the aforementioned embodiment, each of the cross sectional shapes of the external engagement arms 42 is formed in an isosceles trapezoidal shape. Alternatively, for example, a trapezoidal shape including different angles defined by a pair of legs of the trapezoid may be employed. As is a case described above, the cross sectional shape of a first engagement portion of a second embodiment, and the cross sectional shape of a second engagement portion of a third embodiment may include a trapezoidal shape including different angles defined by the pair of legs of the trapezoid.

According to a second modified example, groove portions extending in the first radial direction are provided at the coupling member 40, and engagement pieces (corresponding to the external engagement arms 42) which are displaceable in a radial direction in a state of being fitted into the groove portions constitute the first engagement portion. As is the case of this configuration, recessed portions extending in the second radial direction may be provided at, for example, the end portion of the input gear 30, and protrusions for engagement which are displaceable in the radial direction in a state of being fitted into the recessed portions may be provided at the coupling member 40 to constitute the second engagement portion.

According to the aforementioned configuration of the second modified example, inclination surfaces are provided at contact portions, and biasing members applying the biasing force in a direction in which the inclination surfaces come in contact with one another are provided, and thus the Oldam coupling Cx may be functioned as is the case of the first embodiment, and the contact noise may be inhibited from being generated.

Figure 10:
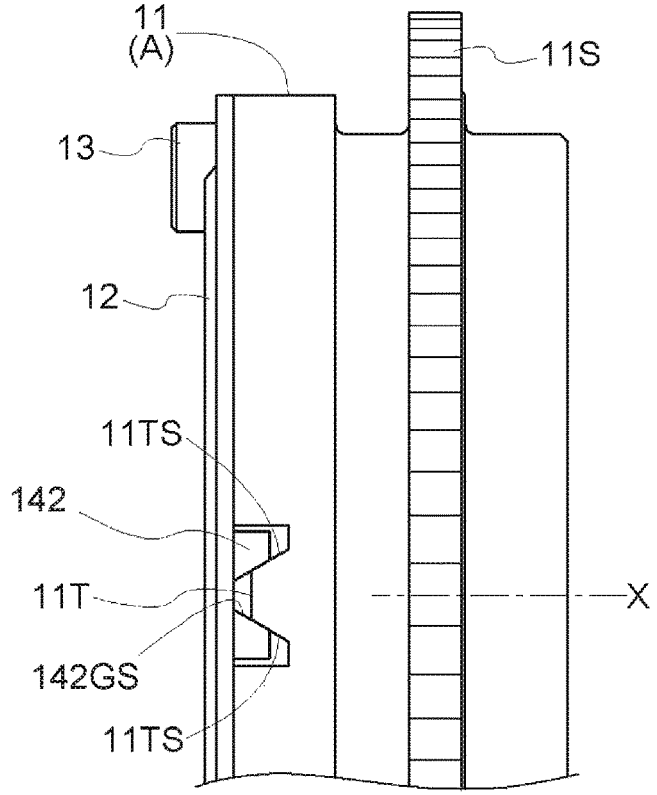
FIG. 10 is a side view of the partial cutout view illustrating a configuration of a second embodiment.
Figure 11:
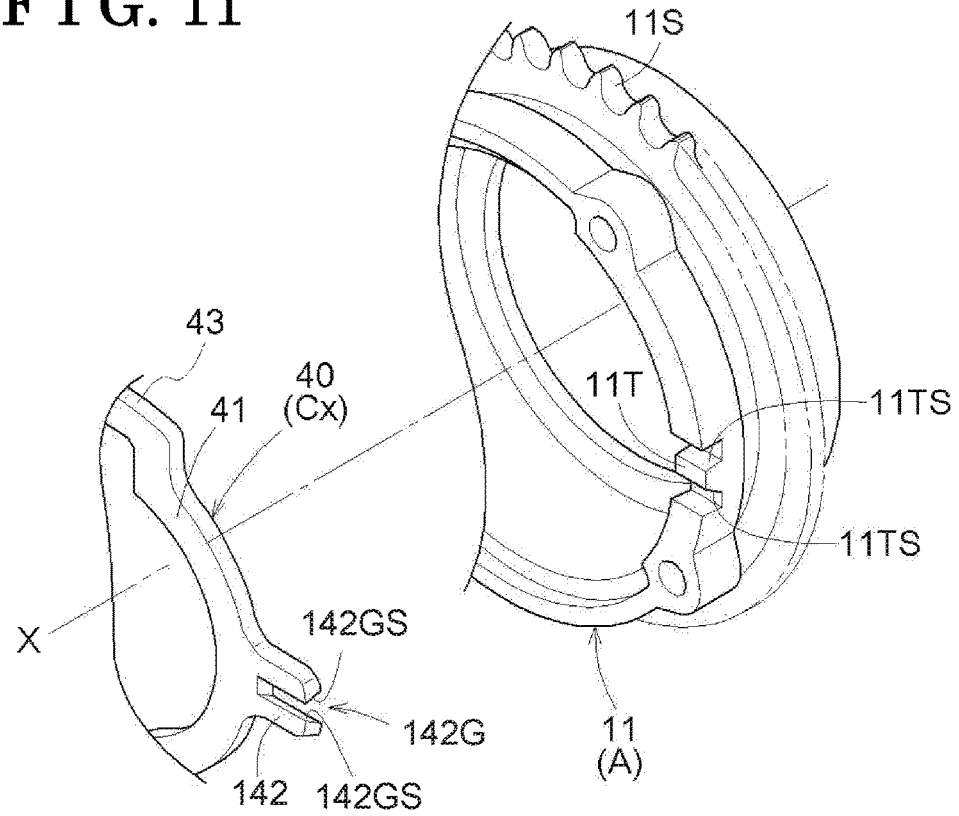
FIG. 11 is a perspective view illustrating the configuration of the second embodiment.

According to the second embodiment, as illustrated in FIGS. 10 and 11, a first protrusion 11T (i.e., serving as the first engagement portion) and a first recessed portion 142G (i.e., serving as the first engagement portion) constitute a first engagement portion. That is, the first protrusion 11T is provided at the outer case 11 of the driving-side rotation member A, the first protrusion 11T protruding in a direction along the rotation axis X at a space into which an external engagement arm 142 is fitted, and extending along the radial direction of the outer case 11. The external engagement arm 142 of the coupling member 40 includes a first recessed portion 142G which is formed in a slit shape, which is fittedly engageable with the first protrusions 11T, and which extends in a protruding direction of the external engagement arm 142.

In the first engagement portion of the second embodiment, the first protrusion 11T includes a pair of first side surfaces 11TS which are oriented to be inclined so that the width of the first protrusion 11T is narrower towards a distal end side having the first recessed portion 142G therein than a first base end side of the first protrusion 11T. The first recessed portion 142G includes a pair of first contact surfaces 142GS which are oriented to be inclined so that the first recessed portion 142G is narrower towards a first side supporting or opposing a distal end of the first protrusion 11T than a first opening side into which the first base end side thereof is fitted.

In the second embodiment, the first protrusion 11T of the outer case 11 relatively moves with the first recessed portion 142G of the external engagement arm 142 in the radial direction in a state of being engaged therewith, and thus the coupling member 40 is functioned as the Oldam coupling Cx. The second embodiment is assumed to include the configuration which is the same as the configuration of the first embodiment except for a part in which the first protrusion 11T and the first recessed portion 142G are engaged with each other.

According to the configuration of the second embodiment, the pair of first side surfaces 11TS and the pair of first contact surfaces 142GS which support the pair of first side surfaces 11TS are maintained in a contact state with one another by biasing force of the first annular spring 35 (not shown in FIGS. 10 and 11, see, for example, FIG. 5). Accordingly, the contact noise is inhibited from being generated. In addition, in this configuration, the first side surfaces 11TS and the first contact surfaces 142GS are maintained in the contact state even in a case of being worn, and thus the contact noise is inhibited from being generated.

In the second embodiment, the first recessed portion 142G is provided as a slit. Alternatively, the first recessed portion 142G may be formed in a groove shape.

In the second embodiment, alternatively, the coupling member 40 may be provided with a protrusion that corresponds to the first protrusion 11T, and the outer case 11 of the driving-side rotation member A may be provided with a recessed portion that corresponds to the first recessed portion 142G. The positional relationship may be reversed from the aforementioned first and second embodiments.

Figure 12:
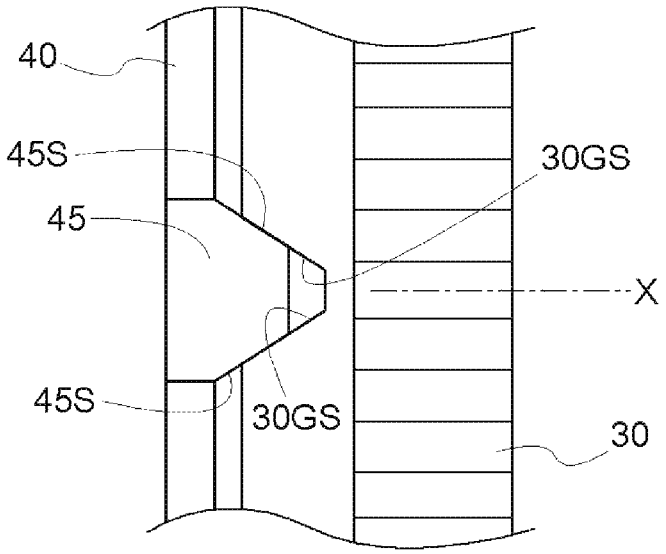
FIG. 12 is a side view of the partial cutout view illustrating a configuration of a third embodiment.
Figure 13:
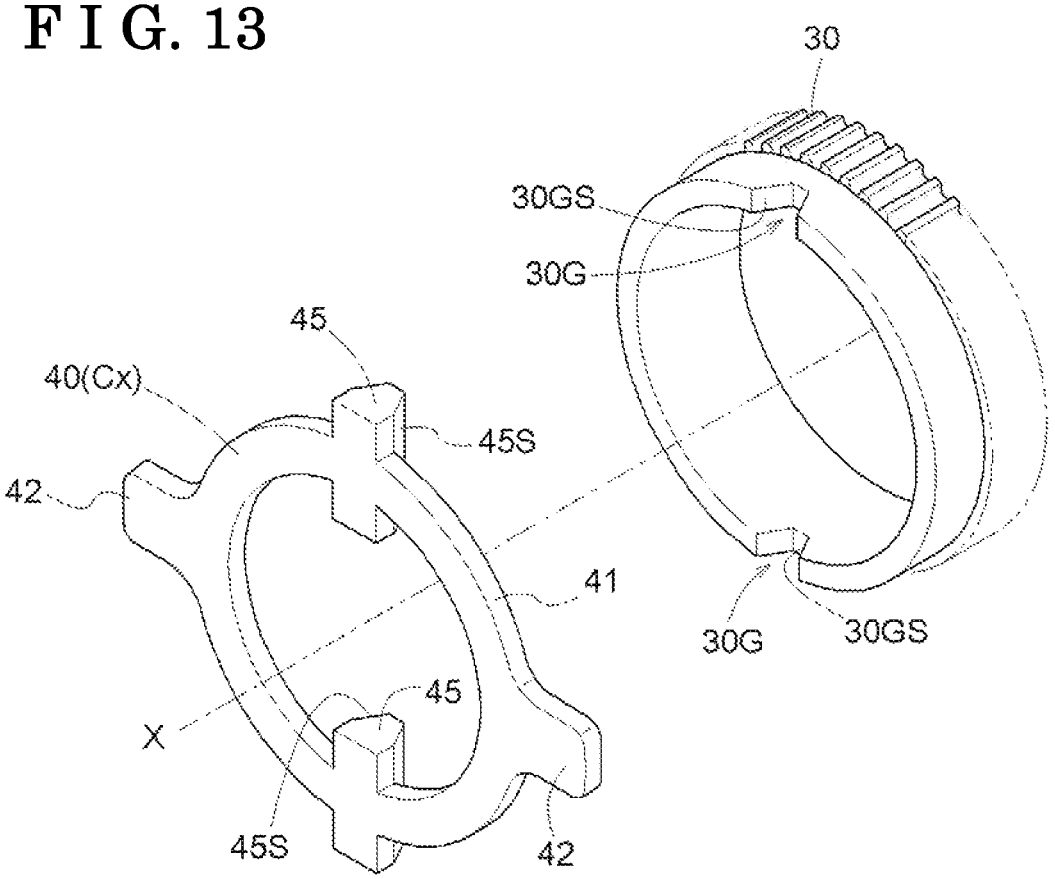
FIG. 13 is a perspective view illustrating the configuration of the third embodiment.

As illustrated in FIGS. 12 and 13, in the third embodiment, the second engagement portion constitutes second protrusions 45 (i.e., serving as the second engagement portion) and second recessed portions 30G (i.e., serving as the second engagement portion). That is, the coupling member 40 includes the second protrusions 45 which protrude along the rotation axis X at surfaces opposing the input gear 30, and which extend in the radial direction. The second recessed portions 30G of the input gear 30 are recessed along the rotation axis X and each is formed in a groove shape in the radial direction, the second recessed portions 30G are provided at end portions of the input gear 30 opposing the coupling member 40.

In the second engagement portion of the third embodiment, the second protrusions 45 each includes a pair of second side surfaces 45S which are oriented to be inclined so that the second protrusion 45 is narrower towards a distal end side where the second recessed portion 30G is provided than a second base end side of the second protrusion 45. The second recessed portions 30G each includes second contact surfaces GS which are oriented to be inclined so that the second recessed portion 30G is narrower towards a second side opposing a distal end of the second protrusion 45 than a second opening side into which the second base end side thereof is fitted.

In the third embodiment, the second protrusion 45 of the coupling member 40 relatively moves in the radial direction in a state of being engaged with the second recessed portions 30G of the outer case 11, and thus the coupling member 40 is functioned as the Oldam coupling Cx. The third embodiment is assumed to be the same as the configuration of the first and second embodiments except for a part in which the second protrusion 45 and the second recessed portion 30G are engaged with each other.

According to this configuration, the second side surfaces 45S and the second contact surfaces 30GS which support the second side surfaces 45S, respectively, are maintained in a contact state with one another by biasing force of the first annular spring 35 (not shown in FIGS. 12 and 13, see, for example, FIG. 5). Accordingly, the contact noise is inhibited from being generated. In addition, in this configuration, each of the second side surfaces 45S and the second contact surfaces 30GS are maintained in the contact state even in a case of being worn, and thus the contact noise is inhibited from being generated.

In the third embodiment, alternatively, an end surface of the input gear 30 may be provided with protrusions that correspond to the second protrusions 45, and the coupling member 40 may be provided with recessed portions that correspond to the second recessed portions 30G, the positional relationship may be reversed from the aforementioned first and second embodiments.

This disclosure may be applied to a variable valve timing control device that specifies a relative rotation phase between a driving-side rotation member and a driven-side rotation member by an electric actuator.

According to the aforementioned embodiment, the variable valve timing control device includes the driving-side rotation member (A) disposed to be rotatable about the rotation axis (X) and rotating synchronously with the crankshaft (1) of the internal combustion engine (the engine E), the driven-side rotation member (B) housed in the driving-side rotation member (A) so as to be relatively rotatable with the driving-side rotation member (A) about the rotation axis (X) and rotating integrally with the camshaft (the intake camshaft 2) for opening and closing the valve of the internal combustion engine (the engine E), the phase adjustment mechanism (C) specifying a relative rotation phase between the driving-side rotation member (A) and the driven-side rotation member (B) by the drive force of an electric actuator (the phase control motor M), the phase adjustment mechanism (C) configured by the differential reduction gear mechanism (C) including the output gear (25), the input gear (30), and the connection mechanism (the Oldam coupling Cx), the output gear (25) coaxially disposed with the rotation axis (X) and having inner teeth (25A), the input gear (30) disposed coaxially with an eccentric axis (Y) which is oriented to be in parallel with the rotation axis (X) and having the outer teeth (30A), the outer teeth (30A) including a part which is engaged with a part of the inner teeth (25A) of the output gear (25), the connection mechanism (the Oldam coupling Cx) connecting the input gear (30) and the driving-side rotation member (B) with each other to rotate the input gear (30) and the driving-side rotation member (B); the reduction gear mechanism (C) which revolves the input gear (30) about the rotation axis (X) while rotating the input gear (30) about the eccentric axis (Y) by the drive force of the electric actuator (the phase control motor M), the connection mechanism (the Oldam coupling Cx) including a coupling member (40) which connects the driving-side rotation member (A) and the input gear (30) with each other, the connection mechanism (the Oldam coupling Cx) including the first engagement portion (the external engagement arm 42, the guide groove portion 11G, the first protrusion 11T, the first recessed portion 142G) and the second engagement portion (the engagement protrusion 30T, the internal engagement arm 43, the second recessed portion 30G, the second protrusion 45), the first engagement portion (the external engagement arm 42, the guide groove portion 11G, the first protrusion 11T, the first recessed portion 142G) engaged with the driving-side rotation member (A) so as to be relatively displaceable therewith in the first radial direction, the second engagement portion (the engagement protrusion 30T, the internal engagement arm 43, the second recessed portion 30G, the second protrusion 45) engaged with the input gear (30) so as to be relatively displaceable therewith in the second radial direction which is orthogonal to the first radial direction, and the biasing member (the first annular spring 35, the second annular spring 36) restricting the coupling member (40) from being displaced.

According to the aforementioned configuration, because the biasing force of the biasing member (the first annular spring 35, the second annular spring 36) is applied to the coupling member (40), even in a case where the first engagement portion (the external engagement arm 42, the guide groove portion 11G, the first protrusion 11T, the first recessed portion 142G) between the coupling member (40) and the driving-side rotation member (A) and the second engagement portion (the engagement protrusion 30T, the internal engagement arm 43, the second recessed portion 30G, the second protrusion 45) between the coupling member (40) and the input gear (30) are configured such that, for example, the arm is engaged with the groove portion, the arm and the groove portion are maintained in a contacted state to decrease the clearance therebetween. Accordingly, even in a case where the alternating torque is applied to the camshaft (the intake camshaft 2) when the internal combustion engine (the engine E) is operated, for example, the inner surface of the groove portion and the arm is inhibited from oscillating freely, and the contact noise is inhibited from being generated in response to the action of the alternating torque. Thus, the variable valve timing control device does not generate the contact noise at the engagement portion of the coupling member.

According to the aforementioned embodiment, the biasing member (the first annular spring 35, the second annular spring 36) applies a biasing force to the coupling member (40) in the direction along the rotation axis (X).

According to the aforementioned configuration, the contact noise is inhibited from being generated by establishing a state where the coupling member (40) is in contact with a member adjacent therewith in the direction along the rotation axis (X) by the biasing force of the biasing member (the first annular spring 35, the second annular spring 36). In the configuration, for example, the plate spring or the coil spring may be coaxially disposed with the rotation axis (X) as a biasing member at a position where, for example, the plate spring or the coil spring is in contact with the coupling member (40), and thus the biasing member may be easily disposed.

According to the aforementioned embodiment, the first engagement portion (the external engagement arm 42, the guide groove portion 11G) includes the groove portion (the guide groove portion 11G) and the engagement arm (the external engagement arm 42), the groove portion (the guide groove portion 11G) provided at one of the coupling member (40) and the driving-side rotation member (A), opened in the direction along the rotation axis (X), and extending in a radial direction of the driving-side rotation member (A), the engagement arm (the external engagement arm 42) formed at the other of the coupling member (40) and the driving-side rotation member (A) and being displaceable along the groove portion (the guide groove portion 11G) in a state of being fitted into the groove portion (the guide groove portion 11G), the biasing member (35) is the first spring (35) applying the biasing force to the coupling member (40) in the direction in which the coupling member (40) is pressed to the driving-side rotation member (A), and the groove portion (the guide groove portion 11G) includes the groove side surface (11GS) which is oriented to be inclined so that the groove portion (the guide groove portion 11G) is wider towards a groove opening side where the engagement arm (the external engagement arm 42) is disposed than a groove bottom side, and the engagement arm (the external engagement arm 42) includes an arm side surface (42S) which is oriented to be inclined so that the engagement arm (the external engagement arm 42) is wider towards the arm back surface side opposite to the groove portion (the guide groove portion 11G) than the arm engagement side opposing the groove bottom surface of the groove portion (the guide groove portion 11G).

According to the aforementioned configuration, the groove side surfaces (11GS) of the groove portion (the guide groove portion 11G) and the arm side surfaces (42S) of the engagement arm (the external engagement 42) are in surface-contact with one another by the biasing force of the first spring (35). Accordingly, the groove side surfaces (11GS) and the arm side surfaces (42S) are always in contact with one another, and the contact noise at the positions is inhibited from being generated. According to the configuration, for example, the contacted state of the groove side surfaces (11GS) of the groove portion (11G) and the arm side surfaces (42S) is maintained even in a case of being worn.

According to the aforementioned embodiment, the second engagement portion (the internal engagement arm 43) includes the recessed portion (the engagement recessed portion 43G) and the engagement protrusion (30T), the recessed portion (the engagement recessed portion 43G) provided at one of the coupling member (40) and the input gear (30) and extending in a radial direction in a state of being opened in the direction along the rotation axis (X), the engagement protrusion (30T) formed at the other of the coupling member (40) and the input gear (30) and being displaceable along the recessed portion (the engagement recessed portion 43G) in a state of being fitted into the recessed portion (internal engagement arm 43), the biasing member (36) is the second spring (36) applying the biasing force to the coupling member (40) in a direction in which the coupling member (40) is pressed to the input gear (30), and the recessed portion (the engagement recessed portion 43G) includes the recessed portion side surface (43GS) which is oriented to be inclined so that the recessed portion (the engagement recessed portion 43G) is narrower towards the back portion side opposing the engagement protrusion (30T) than the recessed portion opening side, the recessed portion opening side opposing the engagement protrusion (30T), and the engagement protrusion (30T) includes the protrusion side surface (30TS) which is oriented to be inclined so that the engagement width of the base end side of the engagement protrusion (30T) is wider than an engagement width of the protruding end side of the engagement protrusion (30T).

According to the aforementioned configuration, the recessed portion side surfaces (43GS) of the recessed portion (the engagement recessed portion 43G) and the protrusion side surfaces (30TS) of the engagement protrusion (30T) are in surface-contact with one another by the biasing force of the second spring (36). Accordingly, the recessed portion side surfaces (43GS) and the protrusion side surfaces (30TS) are always in contact with one another, and thus the contact noise at the positions is inhibited from being generated. According to the configuration, for example, the contacted state of the recessed portion side surfaces (43GS) and the protrusion side surfaces (30TS) is maintained even in a case of being worn.

According to the aforementioned embodiment, the first engagement portion (the first protrusion 11T, the first recessed portion 142G) includes the first protrusion (11T) and the first recessed portion (142G), the first protrusion (11T) provided at one of the coupling member (40) and the driving-side rotation member (A), protruding along the rotation axis (X), and extending in the radial direction of the driving-side rotation member (A), and the first recessed portion (142G) formed at the other of the coupling member (40) and the driving-side rotation member (A) and formed in the recessed shape so as to be displaceable along the first protrusion (11T) in a state of being engaged with the first protrusion (11T), the biasing member (35) is the first spring (35) applying the biasing force to the coupling member (40) in the direction in which the coupling member (40) is pressed to the driving-side rotation member (A), and the first protrusion (11T) includes the first side surface (11TS) which is oriented to be inclined so that the first protrusion (11T) is narrower towards the distal end side where the first recessed portion (142G) is provided than the first base end side, and the first recessed portion (142G) includes the first contact surface (142GS) which is oriented to be inclined so that the first recessed portion (142G) is narrower towards the first side opposing the distal end of the first protrusion (11T) than the first opening side into which the first base end side of the first protrusion (11T) is fitted.

According to the aforementioned configuration, the first side surfaces (11TS) of the first protrusion (11T) and the first contact surfaces (142GS) of the first recessed portion (142G) are in surface-contact with one another by the biasing force of the first spring (35). Accordingly, the first side surfaces (11TS) and the first contact surfaces (142GS) are always in contact with one another and the contact noise at the positions is inhibited from being generated. Furthermore, according to the aforementioned configuration, for example, the first side surfaces (11TS) of the first protrusion (11T) and the first contact surfaces (142GS) of the first recessed portion (142G) are maintained in the contact state with one another even being worn.

According to the aforementioned embodiment, the second engagement portion (30G, 45) includes the second protrusion (45) and the second recessed portion (30G), the second protrusion (45) provided at one of the coupling member (40) and the input gear (30) and extending in a radial direction in a state of protruding in a direction along the rotation axis (X), and the second recessed portion (30G) formed at the other of the coupling member (40) and the input gear (30) and formed in the recessed shape so as to be displaceable along the second protrusion (45) in a state of being engaged with the second protrusion (45), the biasing member (36) is a second spring (36) applying the biasing force to the coupling member (40) in the direction in which the coupling member (40) is pressed to the input gear (30), and the second protrusion (45) includes the second side surface (45S) which is oriented to be inclined so that the second protrusion (45) is narrower towards a distal end side where the second recessed portion (30G) is provided than the second base end side, and the second recessed portion (30G) includes the second contact surface (30GS) which is oriented to be inclined so that the second recessed portion (30G) is narrower towards the second side opposing the distal end of the second protrusion (45) than the second opening side into which the second base end side of the second protrusion (45) is fitted.

According to the aforementioned configuration, the second side surfaces (45S) of the second protrusion (45) and the second contact surfaces (30GS) of the second recessed portion (30G) are in surface-contact with one another by the biasing force of the second spring (36). Accordingly, the second side surfaces (45S) and the second contact surfaces (30GS) are always in contact with one another, and the contact noise at the positions is inhibited from being generated. In the configuration, for example, the second side surfaces (45S) and the second contact surfaces (30GS) are maintained in a contact state with one another even being worn.

According to the aforementioned embodiment, the variable valve timing control device includes the driving-side rotation member (A) disposed to be rotatable about the rotation axis (X) and rotating synchronously with the crankshaft (1) of the internal combustion engine (E), the driven-side rotation member (B) housed in the driving-side rotation member (A) so as to be relatively rotatable with the driving-side rotation member (A) about the rotation axis (X) and rotating integrally with the camshaft (the intake camshaft 2) for opening and closing the valve of the internal combustion engine (E), the phase adjustment mechanism (C) specifying the relative rotation phase between the driving-side rotation member (A) and the driven-side rotation member (B) by the drive force of the electric actuator (the phase control motor M), the phase adjustment mechanism (C) configured by the reduction gear mechanism (C) including the input gear (30), the output gear (25), and the connection mechanism (Cx), the input gear (30) including the natural number of teeth and driven by the electric actuator (the phase control motor M), the output gear (25) including the number of teeth which is greater than the natural number of teeth of the input gear (30) by one and meshed with the input gear (30), and the connection mechanism (the Oldam coupling Cx) connecting the input gear (30) and the driving-side rotation member (A) with each other and rotating the input gear (30) and the driving-side rotation member (A), the connection mechanism (the Oldam coupling Cx) including the coupling member (40) which connects the driving-side rotation member (A) and the input gear (30) with each other, the connection mechanism (the Oldam coupling Cx) including the first engagement portion (the external engagement arm 42, the guide groove portion 11G, the first protrusion 11T, the first recessed portion 142G) and the second engagement portion (the engagement protrusion 30T, the internal engagement arm 43, the second recessed portion 30G, the second protrusion 45), the first engagement portion (the external engagement arm 42, the guide groove portion 11G, the first protrusion 11T, the first recessed portion 142G) engaged with the driving-side rotation member (A) so as to be relatively displaceable therewith in the first radial direction, the second engagement portion (the engagement protrusion 30T, the internal engagement arm 43, the second recessed portion 30G, the second protrusion 45) engaged with the input gear (30) so as to be relatively displaceable therewith in the second radial direction which is orthogonal to the first radial direction, and the biasing member (the first annular spring 35, the second annular spring 36) including the first spring (35) and the second spring (36), the first spring (35) biasing the coupling member (40) in a first direction along the rotation axis (X), and the second spring (36) biasing the coupling member (40) in a second direction opposite to the first direction along the rotation axis (X).

According to the aforementioned configuration, the biasing force of the biasing member (the first annular spring 35, the second annular spring 36) is applied to the coupling member (40), and thus even in a case where the first engagement portion (the external engagement arm 42, the guide groove portion 11G, the first protrusion 11T, the first recessed portion 142G) between the coupling member (40) and the driving-side rotation member (B) and the second engagement portion (the engagement protrusion 30T, the internal engagement arm 43, the second recessed portion 30G, the second protrusion 45) between the coupling member (40) and the input gear (30) are configured such that, for example, the arm is engaged with the groove portion, the arm and the groove portion are maintained in a contacted state to decrease the clearance therebetween. Accordingly, even in a case where the alternating torque is applied to the camshaft (the intake camshaft 2) when the internal combustion engine (the engine E) is operated, for example, the inner surface of the groove portion and the arm are inhibited from oscillating freely with each other, and the contact noise is inhibited from being generated in response to the action of the alternating torque. Thus, the variable valve timing control device does not generate the contact noise at the engagement portion of the coupling member (40).

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control device comprising:

a driving-side rotation member disposed to rotate about a rotation axis and rotating synchronously with a crankshaft of an internal combustion engine;

a driven-side rotation member housed in the driving-side rotation member so as to rotate relative to the driving-side rotation member about the rotation axis and rotating integrally with a camshaft configured to open and close a valve of the internal combustion engine;

a phase adjustment mechanism setting a relative rotation phase between the driving-side rotation member and the driven-side rotation member by a drive force of an electric actuator;

the phase adjustment mechanism configured by a differential reduction gear mechanism including an output gear, an input gear, and a connection mechanism, the output gear coaxially disposed with the rotation axis and having inner teeth, the input gear disposed coaxially with an eccentric axis which is oriented to be in parallel with the rotation axis and having outer teeth, the outer teeth including a part which is engaged with a part of the inner teeth of the output gear, the connection mechanism connecting the input gear and the driving-side rotation member with each other to rotate the input gear and the driving-side rotation member; the reduction gear mechanism configured to revolve the output gear about the rotation axis while the input gear is rotated about the eccentric axis by the drive force of the electric actuator;

the connection mechanism including a coupling member which connects the driving-side rotation member and the input gear with each other, the connection mechanism including a first engagement portion and a second engagement portion, the first engagement portion engaged with the driving-side rotation member so as to be displaced relative to each other in a first radial direction, the second engagement portion engaged with the input gear so as to be displaced relative to each other in a second radial direction which is orthogonal to the first radial direction; and a biasing member restricting the coupling member from being displaced.

2. The variable valve timing control device according to claim 1, wherein the biasing member applies a biasing force to the coupling member in a direction along the rotation axis.

3. The variable valve timing control device according to according to claim 1, wherein the first engagement portion includes a groove portion and an engagement arm, the groove portion provided at one of the coupling member and the driving-side rotation member, opened in a direction along the rotation axis, and extending in a radial direction of the driving-side rotation member, the engagement arm formed at a remaining one of the coupling member and the driving-side rotation member and configured to be displaced along the groove portion in a state of being fitted into the groove portion;

the biasing member is a first spring applying a biasing force to the coupling member in a direction in which the coupling member is pressed to the driving-side rotation member; and the groove portion includes a groove side surface which is oriented to be inclined so that the groove portion is wider towards a groove opening side where the engagement arm is disposed than a groove bottom side, and the engagement arm includes an arm side surface which is oriented to be inclined so that the engagement arm is wider towards an arm back surface side opposite to the groove portion than an arm engagement side opposing a groove bottom surface of the groove portion.

4. The variable valve timing control device according to claim 1, wherein the second engagement portion includes a recessed portion and an engagement protrusion, the recessed portion provided at one of the coupling member and the input gear and extending in a radial direction in a state of being opened in a direction along the rotation axis, the engagement protrusion formed at a remaining one of the coupling member and the input gear and configured to be displaced along the recessed portion in a state of being fitted into the recessed portion;

the biasing member is a second spring applying a biasing force to the coupling member in a direction in which the coupling member is pressed to the input gear; and the recessed portion includes a recessed portion side surface which is oriented to be inclined so that the recessed portion is narrower towards a back portion side opposing the engagement protrusion than a recessed portion opening side, the recessed portion opening side opposing the engagement protrusion, and the engagement protrusion includes a protrusion side surface which is oriented to be inclined so that an engagement width of a base end side of the engagement protrusion is wider than an engagement width of a protruding end side of the engagement protrusion.

5. The variable valve timing control device according to according to claim 1, wherein the first engagement portion includes a first protrusion and a first recessed portion, the first protrusion provided at one of the coupling member and the driving-side rotation member, protruding along the rotation axis, and extending in a radial direction of the driving-side rotation member, and the first recessed portion formed at a remaining one of the coupling member and the driving-side rotation member and formed in a recessed shape so as to be displaced along the first protrusion in a state of being engaged with the first protrusion;

the biasing member is a first spring applying a biasing force to the coupling member in a direction in which the coupling member is pressed to the driving-side rotation member; and the first protrusion includes a first side surface which is oriented to be inclined so that the first protrusion is narrower towards a distal end side where the first recessed portion is provided than a first base end side, and the first recessed portion includes a first contact surface which is oriented to be inclined so that the first recessed portion is narrower towards a first side opposing a distal end of the first protrusion than a first opening side into which the first base end side of the first protrusion is fitted.

6. The variable valve timing control device according to according to claim 1, wherein the second engagement portion includes a second protrusion and a second recessed portion, the second protrusion provided at one of the coupling member and the input gear and extending in a radial direction in a state of protruding in a direction along the rotation axis, and the second recessed portion formed at a remaining one of the coupling member and the input gear and formed in a recessed shape so as to be displaced along the second protrusion in a state of being engaged with the second protrusion;

the biasing member is a second spring applying a biasing force to the coupling member in a direction in which the coupling member is pressed to the input gear; and the second protrusion includes a second side surface which is oriented to be inclined so that the second protrusion is narrower towards a distal end side where the second recessed portion is provided than a second base end side, and the second recessed portion includes a second contact surface which is oriented to be inclined so that the second recessed portion is narrower towards a second side opposing a distal end of the second protrusion than a second opening side into which the second base end side of the second protrusion is fitted.

7. A variable valve timing control device comprising:

a driving-side rotation member disposed to rotate about a rotation axis and rotating synchronously with a crankshaft of an internal combustion engine;

a driven-side rotation member housed in the driving-side rotation member so as to rotate relative to the driving-side rotation member about the rotation axis and rotating integrally with a camshaft configured to open and close a valve of the internal combustion engine;

a phase adjustment mechanism setting a relative rotation phase between the driving-side rotation member and the driven-side rotation member by a drive force of an electric actuator;

the phase adjustment mechanism configured by a reduction gear mechanism including an input gear, an output gear, and a connection mechanism, the input gear including a natural number of teeth and driven by the electric actuator, the output gear including a number of teeth which is greater than the natural number of teeth of the input gear by one and meshed with the input gear, and the connection mechanism connecting the input gear and the driving-side rotation member with each other and rotating the input gear and the driving-side rotation member;

the connection mechanism including a coupling member which connects the driving-side rotation member and the input gear with each other, the connection mechanism including a first engagement portion and a second engagement portion, the first engagement portion engaged with the driving-side rotation member so as to be displaced relative to each other in a first radial direction, the second engagement portion engaged with the input gear so as to be displaced relative to each other in a second radial direction which is orthogonal to the first radial direction; and a biasing member including a first spring and a second spring, the first spring biasing the coupling member in a first direction along the rotation axis, and the second spring biasing the coupling member in a second direction opposite to the first direction along the rotation axis.

* * * * *